United States Patent [19]

Hara et al.

[11] Patent Number: 4,539,951

[45] Date of Patent: Sep. 10, 1985

[54] VARIABLE VALVE TIMING MECHANISM

[75] Inventors: Seinosuke Hara, Yokosuka; Kazuyuki Miisho; Yasuo Matsumoto, both of Yokohama; Yasuo Yoshikawa, Yokosuka, all of Japan

[73] Assignee: Nissan Motor Co., Ltd., Yokohama, Japan

[21] Appl. No.: 632,340

[22] Filed: Jul. 19, 1984

[30] Foreign Application Priority Data

Jul. 21, 1983 [JP] Japan ..... 58-134077
Apr. 24, 1984 [JP] Japan ..... 59-81052

[51] Int. Cl.[3] ..... F01L 1/34; F01L 1/04; F01L 13/00

[52] U.S. Cl. ..... 123/90.17; 123/90.27; 123/90.31; 123/90.41

[58] Field of Search ..... 123/90.16, 90.15, 90.17, 123/90.27, 90.31, 90.39, 90.41, 90.44

[56] References Cited

U.S. PATENT DOCUMENTS

| | | | |
|---|---|---|---|
| 2,838,946 | 6/1958 | Kiekhaefer | 123/90.31 |
| 2,997,991 | 8/1961 | Roan | 123/90.16 |
| 3,139,872 | 7/1964 | Thompson | 123/90.41 |
| 3,403,663 | 10/1968 | Wagner | 123/90.16 |
| 3,413,965 | 12/1968 | Gavasso | 123/90.16 |
| 3,603,296 | 9/1971 | Mitchell | 123/90.31 |
| 3,897,760 | 8/1975 | Hisserich | 123/90.16 |
| 3,913,548 | 10/1975 | Wilson | 123/90.16 |
| 4,084,557 | 4/1978 | Luria | 123/90.15 |
| 4,192,263 | 3/1980 | Kitagawa et al. | 123/90.39 |
| 4,205,634 | 6/1980 | Tourtelot | 123/90.15 |
| 4,429,853 | 2/1984 | Chaffiotte et al. | 123/90.16 |
| 4,438,736 | 3/1984 | Hara et al. | 123/90.16 |

FOREIGN PATENT DOCUMENTS

| | | | |
|---|---|---|---|
| 0067311 | 12/1982 | European Pat. Off. . | |
| 2647332 | 4/1978 | Fed. Rep. of Germany | 123/90.17 |
| 2453979 | 7/1980 | France . | |
| 0188717 | 11/1982 | Japan | 123/90.15 |
| 0195810 | 12/1982 | Japan | 123/90.16 |
| 0088413 | 5/1983 | Japan | 123/90.15 |

OTHER PUBLICATIONS

PCT/JP78/00066, 7-1979 by Matsui.

*Primary Examiner*—Craig R. Feinberg
*Assistant Examiner*—David A. Okonsky
*Attorney, Agent, or Firm*—Schwartz, Jeffery, Schwaab, Mack, Blumenthal & Evans

[57] ABSTRACT

An angular position of a lever with which a rocker arm contacts to define a fulcrum therebetween is varied by rotation of a cam which is installed in a manner to be rotatable relative to its cam shaft and drivingly connected through a spring to the cam shaft or to an output shaft of a driving system.

25 Claims, 20 Drawing Figures

VARIABLE VALVE TIMING MECHANISM

BACKGROUND OF THE INVENTION

1. Field of the Invention

The present invention relates generally to a valve train for an internal combustion engine and more particularly to a mechanism for varying the timing of the valves of an internal combustion engine in order to obtain optimum efficiency and performance of the engine throughout the operating speed range.

2. Description of the Prior Art

Because of the fact that internal combustion engines for automotive vehicles must operate under widely varying speed and load conditions, the timing of the intake and exhaust valves of such engines is chosen so as to provide a resonable degree of efficiency and performance throughout the expected range of speeds and loads. Such timing, however, does not provide optimum efficiency and performance throughout any particularly range of operating speeds and loads. Accordingly, efforts have been made to improve the efficiency and performance of automotive internal combustion engines, particularly those employing poppet-type intake and exhaust valves, by varying the timing of such valves in relation to the working cycles of their respective cylinders.

One of the mechanisms having been heretofore developed for varying the timing of the valves of an internal combustion engine in accordance with varying operating conditions, as disclosed in the U.S. Pat. No. 3,413,965, utilizes an elongated lever pivoted at one end and extending parallel to a rocker arm located in the actuating train of a reciprocating valve, with the inner surface of the lever contacting the outer surface of the rocker arm. The contacting surfaces are contoured so that the lever serves as a fulcrum for the rocking motion of the rocker arm. During the rocking motion, the contact point between the lever and the rocker arm moves along the surfaces. An eccentric portion of a rotatable shaft contacts the outer surface of the lever and rotation of the shaft pivots the lever, thereby changing the crankshaft angle at which the valve begins its operational event.

While the above mechanism has accomplished its desired objective, it has not proved entirely satisfactory for the reason that a large torque is required for rotating the rotational shaft, resulting in a large loss of energy leading to deterioration in the efficiency and performance of an engine as well as a large-sized hydraulic driving system for the drive of the rotatable shaft. This is due to the fact that a valve spring, when the associated valve is unseated to open, strongly pushes the lever against its pivot shaft and the rotatable shaft, thus subjecting the lever and the rotational shaft to large frictional forces. When the mechanism is used in an engine having four cylinders or more, the rotatable shaft is always subject to large frictional force since in such an engine there is always at least one valve which is unseated to open.

SUMMARY OF THE INVENTION

In accordance with the present invention, there is provided a novel and improved variable valve timing mechanism for a valve of an internal combustion engine, which comprises a lever pivotally mounted at one end thereof, a rocker arm engaging the lever to define a fulcrum therebetween, a cam shaft located adjacent the other end of the lever, a cam having a hole through which the cam shaft extends in a manner to allow the cam to be rotatable relative thereto, the cam engaging the other end of the lever and rotatable to vary an angular position of the lever relative to the rocker arm for thereby varying the timing of the valve, driving means for driving the cam in accordance with engine operating conditions and including an output shaft, and resilient means for resiliently interconnecting the output shaft and the cam.

This mechanism makes it possible to temporarily store a torque for driving the cam in the resilient means when the valve is unseated to open and, when the valve is seated, rotate the cam into a desired angular position with the torque stored in the resilient means. The torque required for rotation of the cam in the above mechanism can be smaller as compared with that in the prior art mechanism since it now becomes unnecessary to drive the cam against the strong reaction force of the valve springs.

It is accordingly an object of the present invention to provide a novel and improved variable valve timing mechanism for a valve of an internal combustion engine which can reduce the power required for the variable valve timing control.

It is another object of the present invention to provide a novel and improved variable valve timing mechanism of the above described character which can reduce the capacity and size of a driving system for driving a cam operative to induce variation of a valve timing.

It is a further object of the present invention to provide a novel and improved variable valve timing mechanism of the above described character which can reduce the loss of power output of the engine due to the control of the variable valve timing.

It is a still further object of the present invention to provide a novel and improved variable valve timing mechanism of the above described character which can provide a highly stable and reliable valve control.

BRIEF DESCRIPTION OF THE DRAWINGS

The features and advantages of the variable valve timing mechanism according to the present invention will become more clearly appreciated from the following description taken in conjunction with the accompanying drawings, in which:

FIGS. 6 to 14 are views showing variants of the mechanism of FIG. 1, in which FIG. 9 is a view taken along the arrow IX in FIG. 8 and in which FIG. 11 is a view taken along the arrow XI in FIG. 10;

DETAILED DESCRIPTION OF THE PREFERRED EMBODIMENTS

Figure 1:
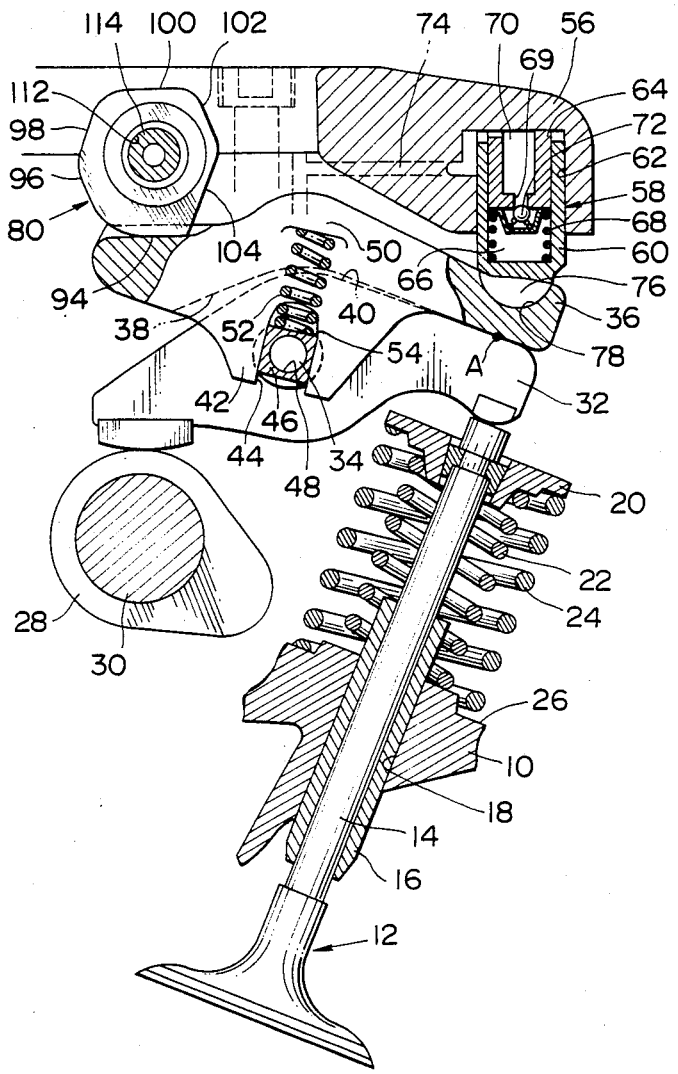
FIG. 1 is a partially sectioned elevational view of a a valve train incorporating a variable valve timing mechanism according to an embodiment of the present invention.

In FIG. 1, a portion of a cylinder head of a multi-cylinder internal combustion engine is illustrated and indicated at 10. The engine, in the present instance, is adapted for use in an automotive application and includes a poppet type reciprocating valve 12 which may be either an intake or exhaust valve.

The valve 12 includes an elongated stem 14 which is shiftably mounted in a guide 16 which is in turn mounted in a bore 18 in the cylinder head 10. A retainer 20 is secured to the upper end of the valve stem 14 and provides a seat for the upper ends of a pair of concentric springs 22 and 24. The lower ends of the valve springs 22 and 24 are supported on an annular surface 26 in the cylinder head 10.

A first cam 28 is formed integral with a first cam shaft 30 and is rotatable therewith in timed relation to the rotation of an engine crankshaft (not shown), i.e., the engine speed. The first cam 28 contacts one end of a rocker arm 32. The other end of the rocker arm 32 contacts the upper end of the valve stem 14. The rocker arm 32 has a shaft 34 fixedly attached to same at a location intermediate between the ends thereof in such a manner that the ends of the shaft 34 project out from either side of the rocker arm 32. A lever 36 extends above the rocker arm 32 so that the lower contoured surface 38 of the lever 36 contacts the upper contoured surface 40 of the rocker arm 32 at a point indicated at A in FIG. 1. The contact point A serves as a fulcrum or pivot point of the rocker arm 32 during operation of the valve train. The lever 36 is provided on either side thereof with a pair of guide forks 42 formed with guide slots 44. A pair of rectangular slides 46 respectively formed with round guide holes 48 are mounted in the guide slots 44 for movement in the direction transversing the axis of the guide hole 48 but against rotation about the axis of same. The opposed end portions of the shaft 34 are rotatably received in the guide holes 48 of the slides 46. The lever 36 is also provided on either side thereof with a pair of projections 50 which provide seats for the upper ends of springs 52. The lower ends of the springs 52 are supported on flat sides 54 of the rectangular slides 46. The springs 52 are of a small spring constant and always urge the rocker arm 32 and the lever 36 away from each other.

The valve side end of the lever 36 (i.e., an end nearer to the upper end of the valve stem 14) is pivotally mounted on a stationary bracket 56 located thereabove by way of a hydraulic lash eliminator 58. The bracket 56 is bolted to or otherwise secured to the engine cylinder 10. The lash eliminator 58 is of the conventional type and includes an outer piston 60 slidable within a hole 62 formed in the bracket 56, an inner piston 64 concentric with and slidable within the outer piston 60 and defining therebetween an oil chamber 66, a spring 68 disposed within the oil chamber 66 and urging the outer piston 60 to protrude from the hole 62 toward the lever 36 and the inner piston 64 against a wall of the bracket 56 defining an inner axial end of the hole 62, a port 69 formed in the inner piston 64 for providing communication between the oil chamber 66 and another oil chamber 70 formed in the inner piston 64, through which port 69 oil flows into the oil chamber 66 when the outer piston 60 is moved outward, and a check ball 72 provided at the port 69 to prevent oil from flowing back. The oil chamber 70 is communicated through an oil supply passage 74 with a source of oil under pressure, as for example engine oil, and is always filled with oil under pressure. The lower end 76 of the outer piston 60 protruding from the hole 62 of the bracket 56 is formed into a semi-spherical shape and fitted in a correspondingly shaped socket 78 formed in the valve side end of the lever 36. When a gap or lash is created between the rocker arm 32 and the valve stem 14 or between the rocker arm 32 and the lever 36, the outer piston 60, urged by the spring 68, moves outward and eliminates the lash and, at the same time, oil flows into the oil chamber 70 through the port 69. The oil which has flown in is prevented from backflow by the check ball 72.

The other end of the lever 36, i.e., the first cam side end of the lever 36 is urged against a second cam 80 under the bias of the springs 52.

Figure 2:
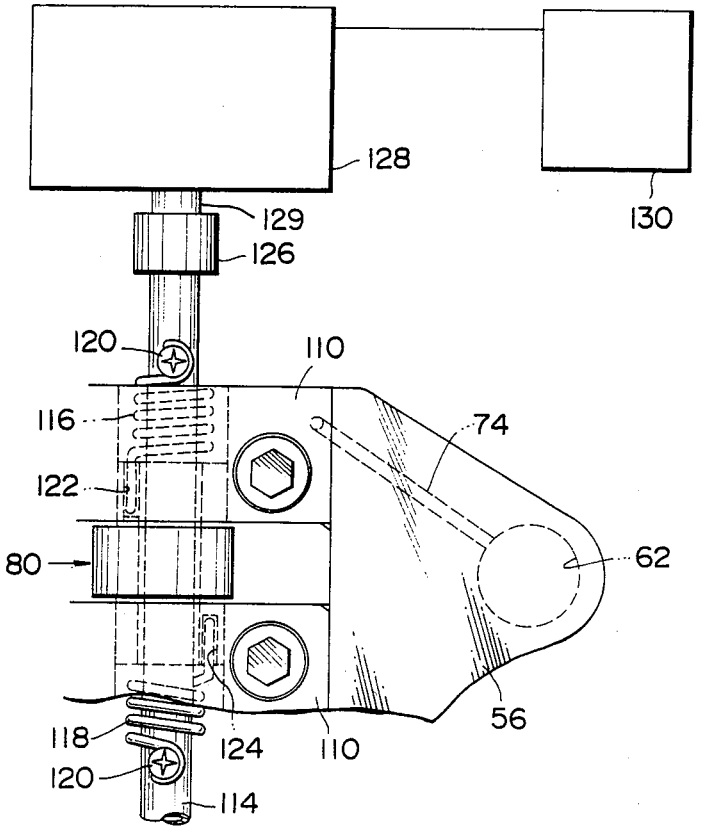
FIG. 2 is a plan view of the mechanism of FIG. 1, with a stepping motor and its control circuit being diagrammatically shown.
Figure 3:
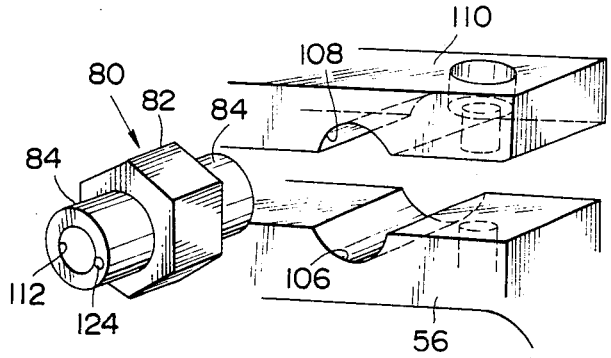
FIG. 3 is an exploded view of the cam and its plain bearings utilized in the mechanism of FIG. 1.

With reference to FIGS. 2 and 3 in addition to FIG. 1, the second cam 80 has an annular stepped configuration and includes a larger-circumference central portion 82 and a pair of smaller-circumference journal portions 84 which are axially aligned with each other and respectively protrude from the axial ends of the central portion 82 in opposite directions. The second cam 80 is formed at the circumference of the central portion 82 thereof with a cam surface consisting of six nearly flat cam surface portions 94–104 which are provided successively throughout the circumference of the central portion 82. The cam surface portions 94–104 are adapted to effect stepwisely varying cam lifts for thereby inducing a stepwise variation of the timing of the valve 12. The second cam 80 is rotatably mounted at the journal portions 84 on the bracket 56. To this end, the bracket 56 is formed with semi-cylindrical grooves 106 which cooperate with similarly shaped grooves 108 formed in a pair of holders 110 to form a pair of plain bearings in which the journal portions 84 of the second cam 80 are rotatably contained, respectively. The holders 110 and the portions of the bracket 56 to which the holders 110 are attached are positioned on the opposite sides of the central portion 82 of the second cam 80 and adapted to be abuttingly engageable with the opposed axial ends of the central portion 82 so that the second cam 80 is axially held in place. The holders 110 are bolted to the bracket 56 as shown in FIGS. 2 and 3.

The second cam 80 is also formed with a concentric hole 112, i.e., an axial hole 112 concentric with the axis of rotation of the central portion 82 or the axes of the journal portions 84, in which a second cam shaft 114 is rotatably disposed, i.e., the second cam 80 is rotatable relative to the second cam shaft 114 which is arranged to pass through the hole 112 thereof. A pair of coil springs 116 and 118 are positioned around the second cam shaft 114 on the opposite sides of the second cam 80. Each spring 116 or 118 has an end attached to the second cam shaft 114 by means of a set screw 120 and the other end attached to the second cam 80 by being inserted into an axial hole 122 or 124 formed in an axially outside end of the journal portion 84. Preferably, the other ends of the coil springs 116 and 118 are attached to the journal portion 84 at such positions thereon that differ from each other by 180° when observed in an elevational view. This is effective for preventing partial engagement of the second cam shaft 114 with the hole 112 of the second cam 80.

In the foregoing, the valve train includes a plurality of such second cams 80 and second cam shafts 114 which are respectively provided as many as the cylinders of the engine so each cam 80 is mounted on each cam shaft 114.

As shown in FIG. 2, an end of the second cam shaft 114 is connected through a coupling 126 to a stepping motor 128. The stepping motor 128 is actuated by a conventional control circuit 130 to drive the second cam shaft 114 in accordance with engine operating conditions, i.e., in accordance with parameters such as engine rpm, choke valve opening degree, coolant temperature, intake air flow rate, induction vacuum, etc.

The operation of the above described mechanism will now be described.

As the engine crankshaft (not shown) rotates, the first cam shaft 30 is caused to rotate together with the first cam 28. Rotation of the first cam 28 imparts a rocking motion to the rocker arm 32 which in turn imparts a reciprocating motion to the valve 12. The timing of the valve 12 is variably determined depending upon the cam surface portion 94, 96, 98, 100, 102 or 104 at which the second cam 80 is brought into contact with the lever 36.

Figure 4:
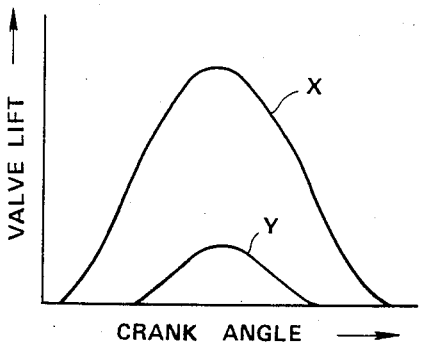
FIG. 4 is a graph of the valve lift curves provided by the mechanism of FIG. 1.

The cam surface portion 94 of the second cam 80 is adapted to effect a maximum lift. When the second cam 80 is brought into contact at the cam surface portion 94 with the lever 36, the lever 36 is pushed down maximumly to assume a lowest possible position or a most counterclockwisely rotated position as shown in FIG. 1. Accordingly, the lower contoured surface 38 of the lever 36 is placed at its lowest possible position or at a position nearest to the upper contoured surface 40 of the rocker arm 32, allowing the contact point A to assume a relatively right-hand position in the drawing when the rocker arm 32 is in contact with the base circle of the first cam 28. The contact point A serves as a fulcrum or pivot point of the rocker arm 32 and moves to the left as the rocker arm 32 is pushed up against the bias of the springs 52 by the lobe of the first cam 28. When this is the case, the valve 12 is opened and closed at such a timing as represented by the curve X in FIG. 4.

The cam surface portion 104 of the second cam 80 is adapted to effect a minimum cam lift. When the second cam 80 is brought into contact at the cam surface 104 with the lever 36, the lever 36 is allowed to move upward from the position illustrated in FIG. 1 or rotate clockwise about the right-hand end thereof and put into a highest possible position or a most clockwisely rotated position. Accordingly, the lower contoured surface 38 of the lever 36 is placed at its highest possible position or at a position remotest from the upper contoured surface 40 of the rocker arm 32, allowing the contact point A to assume a position which is displaced more rightwardly in the drawing when the rocker arm 32 is in contact within the base circle of the first cam 28 as compared with the foregoing corresponding position in the case where the second cam 80 is brought into contact at the cam surface 94 with the lever 36. When this is the case, the valve 12 is opened and closed at such a timing as represented by the curve Y in FIG. 4, i.e., the opening timing of the valve 12 is delayed by the time required for rotation of the rocker arm 32 through which it is put into a position where the upper and lower contoured surfaces 38 and 40 assume the same relative positions as those in the foregoing case where the second cam 80 is in contact at the cam surface 94 with the lever 36 and the rocker arm 32 is in contact with the base circle of the first cam 28. The closing timing of the valve 12 is advanced by the time required for the above mentioned rotation of the rocker arm 32 but in the reverse direction.

The cam surface portions 94–104 of the second cam 80 are adapted to effect stepwisely varying cam lifts, i.e., as the second cam 80 rotates counterclockwise in FIG. 1 from the position where the cam surface portion 94 contacts the lever 36 as illustrated in FIG. 1 toward the position where the cam surface portion 104 contacts the lever 36, it effects stepwisely reducing lifts. By selectively changing the cam surface portion 94, 96, 98, 100, 102 or 104 at which the second cam 80 is brought into contact with the lever 36, the opening and closing timing of the valve 12 can be stepwisely varied.

The angular position of the second cam 80 is controlled by the stepping motor 128 whose drive shaft 129 is drivingly connected through the coupling 126, the second cam shaft 114 and the springs 116 and 118 to the second cam 80. The control circuit 130 produces a pulse signal determined in accordance with various parameters representative of engine operating conditions (such as engine rpm, choke valve opening degree, coolant temperature, intake air flow rate, induction vacuum, etc.), and the pulse signal is given as the input to the stepping motor 128. The stepping motor 128 is actuated by the pulse signal to rotate a predetermined angle, thus causing the second cam shaft 114 to rotate the same angle. In this connection, during lift of the valve 12, the second cam 80 is subject to a large reaction force applied thereto from the valve springs 22 and 24 through the rocker arm 32 and the lever 36. Due to this, when the stepping motor 128 is actuated during lift of the valve 12, only the second cam shaft 114 is caused to rotate, allowing the second cam 80 to remain as it is and twisting the springs 116 and 118. However, when the valve 12 returns to its seat, the second cam 80 is caused to rotate the aforementioned predetermined angle by the torque having been stored in the springs 116 and 118 since the second cam 80 is now subject to only a small force applied thereto from the springs 52.

In the foregoing, it is to be noted that according to the present invention a torque required for rotating the second cam 80 can be considerably smaller as compared with that in the case where the second cam 80 is otherwise integral with the second cam shaft 114. In the prior art variable valve timing mechanism, such a cam corresponding to the second cam 80 is formed integral with or formed so as to be rotatable with its cam shaft. In the prior art mechanisms, a considerably large torque is required for rotating the cam and the cam shaft in question, thus resulting in the necessity of such a driving unit that is of a large power output or a large capacity and therefore large-sized. In contrast to this, the stepping motor 128 utilized in the mechanism of this invention can be of a small power output and therefore small-sized, leading to improvements in loss of engine power output and fuel consumption. Furthermore, the variable valve timing mechanism of this invention is assuredly prevented from such a mulfunction that the stepping motor 128 fails to rotate properly and stops rotating halfway without responding properly to the pulse signal applied thereto from the control circuit 130 due to lack of the power output. Such a mulfunction may possibly occur in case of the prior art mechanisms.

It is further to be noted that the more cylinders the engine has, the more prominent the above effects of the present invention become. For example, in the case of a four-cylinder engine, there is, at all times, at least one valve 12 which is unseated to open. Thus, there is, at all times, at least one cam which requires to be driven to rotate prevailing the large reaction force of the valve springs when adapted to be directly driven by the driving unit as in the conventional mechanism. In the case of an engine having less than four cylinders, the period during which all of the valves are seated to close is quite limited. Thus, it is practical impossible to finish controlling the cams for the valves within such a limited period. Accordingly, the variable valve timing mechanism of the present invention is useful even in such an engine having less than four cylinders.

The second cam 80 is rotatably mounted at the journal portions 84 on the bracket 56 and is adapted not to transfer the load applied thereto from the lever 36 to the second cam shaft 114 but to transfer it to the bracket 56. This is quite effective for reducing the capacity and size of the stepping motor 128.

Figure 5:
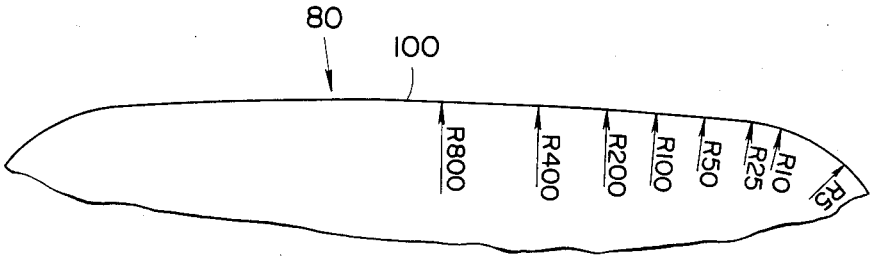
FIG. 5 is an enlarged fragmentary view showing a detailed cam surface profile of the cam utilized in the mechanism of FIG. 1.

FIG. 5 shows an example of a detailed cam surface profile which may be used in the cam surface portions 94–104 of the second cam 80. For example, when the cam surface portion 100 is formed into this profile, it is given a gently curved central area of a radius of curvature R of 800 mm and so formed that as its cam surface area goes nearer to the adjacent cam surface portions 98 and 102, the radius of curvature R with which the cam surface area is shaped becomes smaller.

By the use of such a cam surface profile, it becomes possible to reduce the striking sound which is caused when the second cam 80 is rotated to contact at the different cam surface with the lever 36. Such a cam surface profile of FIG. 5 may be applied to all of the cam surface portions 94–104 or to some of them. It is however desirable that a cam surface portion which is strongly required to be stably in contact with the lever 36 is formed to have a nearly flat central area of a larger radius of curvature R, while a cam surface portion which is not so strongly required to be stably in contact with the lever 36 is formed to have a gently curved central area of a smaller radius of curvature R.

Figure 6:
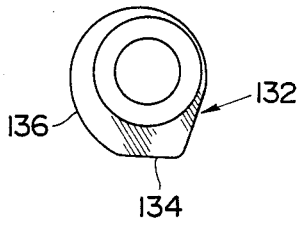

FIG. 6 shows a variant of the second cam 80. A second cam 132 shown in FIG. 6 is provided with a cam surface including only one nearly flat cam surface portion 134. The remaining cam surface portion 136 is curved smoothly and continuously so as to effet a continuously varying lift. The cam surface portion 134 is adapted to effect a maximum lift and thus induce such a valve timing represented by the curve X in FIG. 4. The cam surface portion 134 is used under high engine speed conditions. Under such engine speed conditions, jumping of the valve 12 is liable to occur due to the increased centrifugal force and accordingly the lever 36 requires to be rigidly and stably supported on the second cam 132 so as to provide a sufficient rigidity in support of the rocker arm 32. For this reason, it is desirable for the second cam 132 to have the nearly flat cam surface portion 134 at a location where it is brought into contact with the lever 36 under high engine speed conditions. Under low to medium engine speed conditions, such a rigidity or stability in the support of the lever 36 is not so strongly required, and accordingly the remaining cam surface portion 136 may be continuously curved to induce a continuously varying valve timing.

Figure 7:
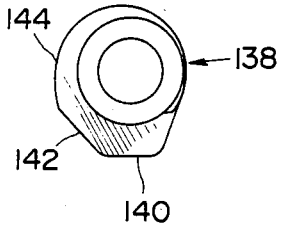

FIG. 7 shows another variant of the second cam 80. A second cam 138 in FIG. 7 is provided with a cam surface including two nearly flat cam surface portions 140 and 142. The remaining cam surface portion 144 is curved smoothly and continuously so as to effect a continuously varying lift. The cam surface portions 140, 142 and 144 are used under low to medium engine speed conditions, medium engine speed conditions and high engine speed conditions, respectively. The second cam 138 can provide a more rigid and stable support of the lever 36 under medium engine speed conditions as compared with the second cam 132.

Figure 8:
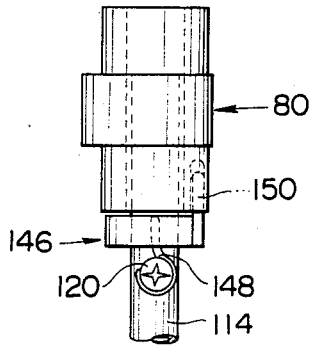
Figure 9:
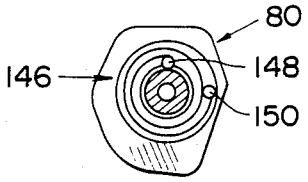

FIGS. 8 and 9 show a variant of the coil spring 118 resiliently interconnecting the second cam 80 and the second cam shaft 114. According to this varient, a spiral spring 146 is employed and attached at the inner and outer ends thereof to the second cam shaft 114 and the second cam 80, respectively. To this end, the inner and outer ends of the spiral spring 146 has secured thereto a hook 148 and a pin 150, respectively. By this, since the space for installation of the spring 146 can be smaller with respect to the axial direction of the second cam shaft 114, design and layout of the mechanism with respect to the axial direction of the second cam shafts 114 become easier particularly when the mechanism is applied to a multi-cylinder engine.

While the coil spring 118 and the spiral spring 146 have been described and shown in the foregoing for resiliently interconnecting the second cam 80 and the second cam shaft 114, such a spring may be provided on either side of the second cam 80 or on one side only for producing the substantially the same effect.

Figure 10:
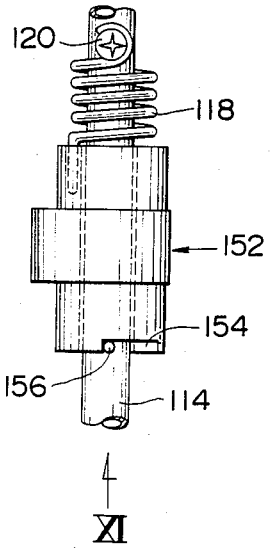
Figure 11:
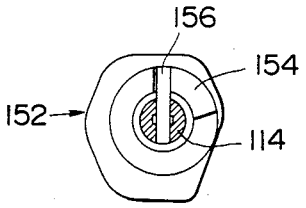

FIGS. 10 and 11 show a further variant of the second cam 80. A second cam 152 shown in FIGS. 10 and 11 is substantially similar to the cam 80 except that it is resiliently connected at one end thereof to the second cam shaft 114 by a single spring 118 and formed at the other end thereof with a groove 154 of a predetermined angular extension. The second cam shaft 114 has secured thereto a stopper pin 156 which is movable in the groove 154 and engageable with the ends of the groove 154 for preventing further rotation of the second cam shaft 114 relative to the second cam 152. By this, over-rotation of the second cam 152 due to the inertia thereof can be prevented, and the coil spring 118 is assuredly prevented from over-twisting and therefore from permanent set in fatigue.

Figure 12:
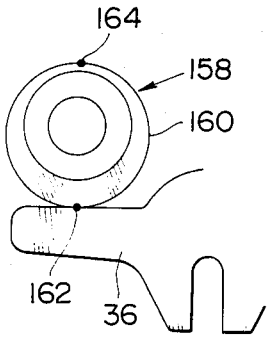

FIG. 12 shows a further variant of the second cam 80. A second cam 158 according to this variant has a curved cam surface 160 extending throughout the circumference thereof. The cam surface 160 is so formed that, when it is brought into contact at its maximum lift effecting portion 162 or a minimum lift effecting portion 164 with the lever 36, it receives from the lever 36 a load toward the axis or center of rotation of the second cam 158. Due to this, when brought into contact at those cam surface portions 162 and 164 with the lever 36, the second cam 158 is not urged by the lever 36 to rotate. The second cam 158 thus can stably and rigidly support the lever 36 under high and low engine speed conditions as well as can induce continuous variation of the timing of the valve 12 under all the engine speed conditions.

Figure 13:
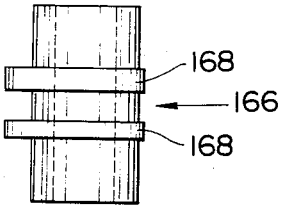

FIG. 13 shows a further variant of the second cam 80. A second cam 166 according to this variant is formed to have two axially spaced cam surfaces 168 having the same cam profile. By this, the inertial mass of the second cam 168 can be decreased, whereby the responsiveness of the mechanism can be improved.

Figure 14:
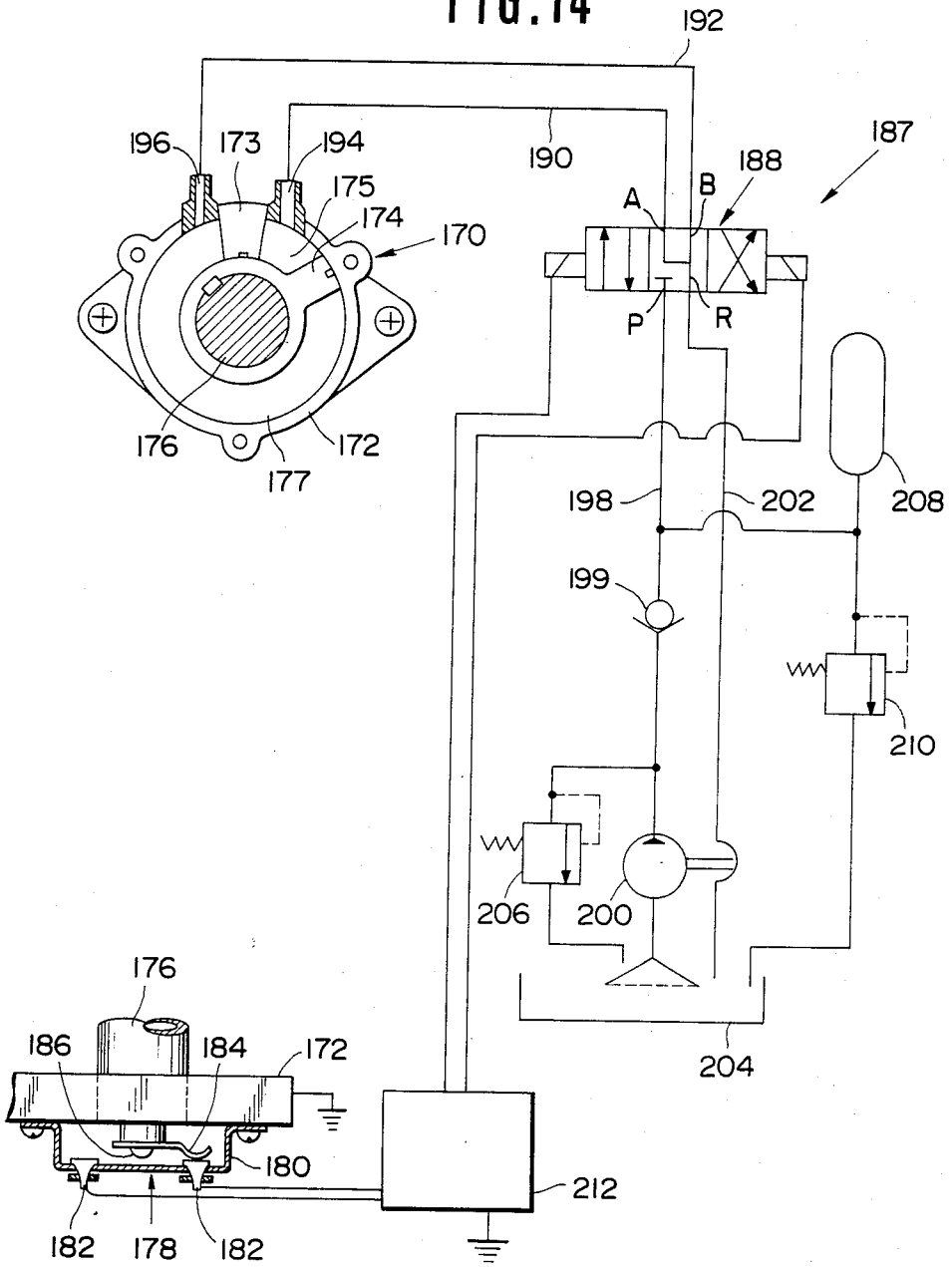

FIG. 14 shows a variant of the stepping motor 128 and the control circuit 130. In this variant, there is used a hydraulic actuator 170 including a housing 172, a vane 174 rotatable within the housing 172 and cooperating with a partition wall 173 of the housing 172 to define first and second chambers 175 and 177 which are variable in volume depending upon the angular position of the vane 174, and a drive shaft 176 keyed to the vane 174 for rotation therewith. The drive shaft 176 has an end drivingly connected through the aforementioned coupling 126 to the second cam shaft 114 and the other end where it is provided with an angular position sensor 178 for sensing the angular position of the drive shaft 176 of the actuator 170. The angular position sensor 178 consists of an insulator cover 180 secured to the housing 172, a plurality of terminals 182 which are provided as many as the nearly flat cam surfaces of the second cam (six terminals in the case where the second cam 80 is used) and which are installed on the insulator cover 180, and a brush 184 secured to the drive shaft 176 with a screw 186 for rotation therewith.

There is also provided a hydraulic control circuit 187 including a directional control valve 188 whose A and B ports are connected through passages 190 and 192 to first and second ports 194 and 196 of the actuator 170, respectively and whose P port is connected through a passage 198 having disposed therein a check valve 199 to an oil pump 200 while R port through a passage 202 to an oil reservoir 204, respectively. The hydraulic control circuit 187 further includes a relief valve 206 connected to the passage 198 for regulating the discharge pressure of the oil pump 200 to a predetermined value, an accumulator 208 connected to the passage 198 between the check valve 199 and the P port of the directional control valve 188, and a relief valve 210 connected to the accumulator 208 to regulate the oil pressure accumulated therein.

The angular position sensor 178 produces a signal representative of the angular position of the drive shaft 176 and therefore the second cam shaft 114 and gives it as the input to an electric control circuit 212. The electric control circuit 212 further receives from other sensors (not shown) such signals that are representative of engine operating conditions, i.e., parameters such as engine rpm, choke valve opening degree, coolant temperature, intake air flow rate, induction vacuum, etc. and produces, based on such signals, a signal for controlling energization of the directional control valve 188.

The directional control valve 188 is shown in FIG. 14 in its neutral position which is assumed thereby when neither of left-hand and right-hand solenoid (not designated) are energized. When the left-hand solenoid is energized, the directional control valve 188 takes a left-hand position in the drawing in which the A port is communicated with the P port while the B port is communicated with the R port, whereby oil under pressure is allowed to flow through the passage 190 and the first port 194 into the first chamber 175 while oil having remained in the second chamber 177 is allowed to flow through the passage 192 toward the oil reservoir 204. By this, the vane 170 is caused to rotate clockwise in the drawing, causing the second cam shaft 114 to rotate in the corresponding direction. When the second cam shaft 114 is rotated into a desired angular position where it urges the second cam 80 to be brought into contact at a desired cam surface portion with the lever 36, the brush 184 comes in contact with one of the terminals 182 corresponding to the desired cam surface portion whereupon the control circuit 212, in response to a signal from the angular position sensor 178, produces a signal for deenergizing the left-hand solenoid of the directional control valve 188 and thereby allowing the valve 188 to return to the neutral position. By this, the vane 170 is held in the desired position together with the second cam shaft 114.

When the right-hand solenoid is energized, the directional control valve 188 takes a right-hand position in the drawing in which the B port is communicated with the P port while the A port is communicated with the R port, whereby oil under pressure is allowed to flow through the passage 192 and the second port 196 into the second chamber 177 while oil having remained in the first chamber 175 is allowed to flow through the passage 190 toward the oil reservoir 204. In the above manner, the vane 170 can be rotated counterclockwise in the drawing into a desired angular position together with the second cam shaft 114.

In the above, it is to be noted that the directional control valve 188 is of the ABR port connection type wherein the P port is closed at its neutral position and the accumulator 208 is adapted to accumulate the discharge pressure of the oil pump 200 when the directional control valve 188 is being held in its neutral position. The oil pressure stored in the accumulator 208 can be used on the following operation of the actuator 170. This contributes to reduction of the capacity and size of the oil pump 200.

Figure 15:
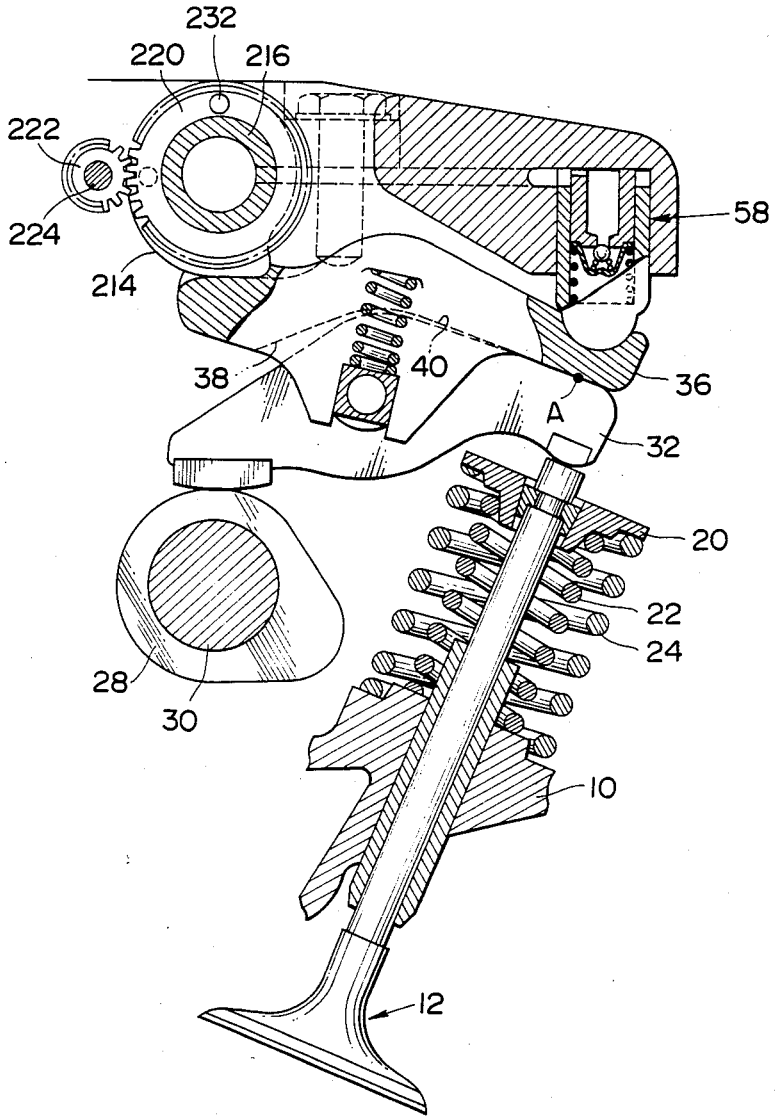
FIG. 15 is a view similar to FIG. 1 but showing a modified embodiment of the present invention.
Figure 16:
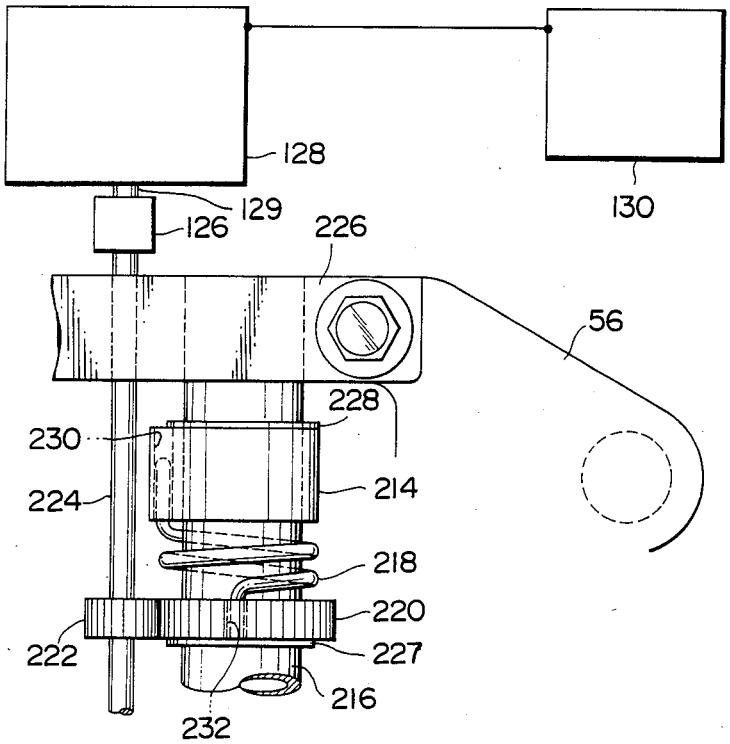
FIG. 16 is a plan view of the mechanism of FIG. 15, with a stepping motor and its control circuit being diagrammatically shown.

FIGS. 15 and 16 show another embodiment in which parts and portions similar and corresponding to those of the previous embodiment of FIGS. 1–3 are designated by the same reference characters as their corresponding parts and portions and will not be described again.

In this embodiment, a second cam 214 is rotatably mounted on a stationary second cam shaft 216 and is drivingly connected to the stepping motor 128 through a coil spring 218, a pair of first and second gears 220 and 222 and a drive shaft 224. More specifically, the drive shaft 224 is drivingly connected through the coupling 126 with the drive shaft 129 of the stepping motor 128. The second gear 222 is a pinion and has a smaller number of teeth as compared with the first gear 220. The second gear 222 is mounted on the drive shaft 224 and keyed or otherwise secured thereto for rotation together therwith. The drive shaft 224 and the second cam shaft 216 are arranged in parallel to each other, and the drive shaft 224 is rotatably mounted on the bracket 56 while the second cam shaft 216 stationarily by means of a pair of common holders 226 (though only one is shown). The first gear 220 in mesh with the second gear 222 is rotatably mounted on the second cam shaft 216 and is urged against a snap ring 227 mounted on the second cam shaft 216 under the bias of the coil spring 218 for thereby being axially held in place on the second cam shaft 216. The first gear 220 may otherwise be keyed to or secured to the cam shaft 216 when the latter is rotatably installed. The second cam 214 has, for example, such cam surface portions similar to those 94–104 of the cam 80 of the previous embodiment and is urged against a snap ring 228 mounted on the second cam shaft 216. The coil spring 218 is positioned around the second cam shaft 216 and interposed between the second cam 214 and the first gear 220 to urge same in the opposite directions. The second cam 214 and the first gear 220 are respectively formed with axial holes 230 and 232 adjacent the outer peripheries thereof, and the opposed ends of the coil spring 218 are inserted into the axial holes 230 and 232 for thereby being attached to the second cam 214 and the first gear 220, respectively.

In operation, the second cam 214 is driven by the stepping motor 128 in the direction opposite to the direction of rotation of the stepping motor 128. Output power of the stepping motor 128 is multiplied upon transmission from the second gear 222 to the first gear 220. This contributes to reduction in the capacity and size of the stepping motor 128. Except for the above, this embodiment can produce substantially the same effects as the previous embodiment.

Figure 17:
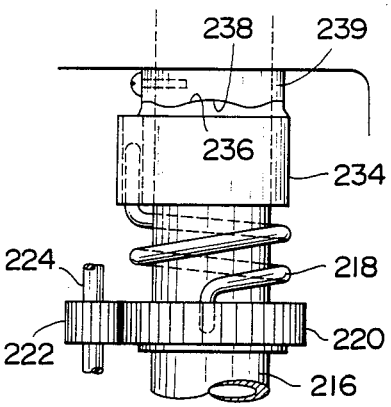
FIGS. 17 to 20 are views showing variants of the mechanism of FIG. 15.

FIG. 17 shows a variant of the second cam 214.

According to this variant, a second cam 234 has a waved axial end 236 opposite to the end facing the first gear 220. The waved axial end 236 is adapted to snugly fit in a correspondingly shaped axial end 238 of a collar 239 secured to the second cam shaft 216. The wave shape is so formed that the waved end 236 of the second cam 214 snugly fits in the end 238 of the collar 230 only when some of the cam surface portions 94–104 of the second cam 214 is stably or correctly in contact with the lever 36. Due to the frictional engagement of the waved ends 236 and 238, the second cam 234 is assuredly prevented from over-rotation beyond a desired angular position.

Figure 18:
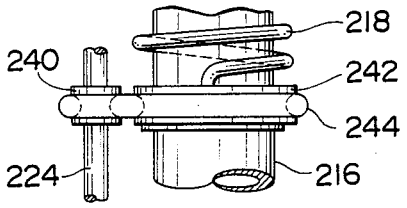
Figure 19:
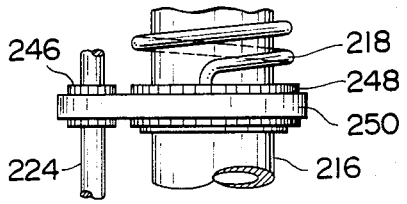
Figure 20:
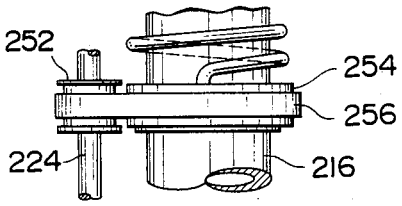

FIGS. 18–20 show variants of the first and second gears 220 and 222. In the variant of FIG. 18, a pair of main and follower pulleys 240 and 242 and a belt 244 of a round section are employed in place of the gears 220 and 222. The main pulley 240 is mounted on the drive shaft 224 for rotation therewith. The second cam shaft 216 in this variant is rotatably mounted on the bracket 56 and the follower pulley 242 is mounted on the second cam shaft 216 for rotation therewith. The belt 244 is arranged to pass about the main and follower pulleys 240 and 242 to transmit power from the main pulley 240 to the follower pulley 242.

In the variant of FIG. 19, a pair of cog wheels 246 and 248 and a cog belt 250 placed therearound are utilized.

In the variant of FIG. 20, a pair of pulleys 252 and 254 and a flat belt 256 placed therearound are utilized.

The above variants can produce substantially the same effects as the embodiment of FIGS. 15 and 16.

What is claimed is:

1. A variable valve timing mechanism for a valve of an internal combustion engine, comprising:

a lever pivotally mounted at one end thereof;

a rocker arm engaging said lever to define fulcrum therebetween;

a cam shaft located adjacent the other end of said lever;

a cam having a hole through which said cam shaft extends in a manner to allow said cam to be rotatable relative thereto, said cam engaging said other end of said lever and rotatable to vary an angular position of said lever relative to said rocker arm for thereby varying the timing of said valve;

driving means for driving said cam in accordance with engine operating conditions and including a rotatable output shaft; and resilient means for resiliently transmitting rotational motion of said output shaft to said cam so as to cause rotation of said cam in response to rotation of said output shaft when said rocker arm assures a predetermined position being in non-actuating contact with said valve.

2. A variable valve timing mechanism as set forth in claim 1, in which said cam is loose-fitted on said cam shaft.

3. A variable valve timing mechanism as set forth in claim 1, in which said cam is formed with two cam surfaces which are spaced axially of said cam shaft and which have the same cam profile.

4. A variable valve timing mechanism as set forth in claim 1, said cam is formed with a curved cam surface throughout the outer circumference thereof, said curved cam surface being formed so that it receives from said lever a load toward the center of rotation of said cam when brought into contact at two diametrically opposed cam surface portions, said cam being brought into contact at said two diametrically opposed cam surface portions with said lever under high engine speed conditions and low engine speed conditions, respectively.

5. A variable valve timing mechanism as set forth in claim 1, in which said driving means further comprises a drive shaft drivingly connected to said output shaft, a pair of cog wheels respectively mounted on said drive shaft and said cam shaft for rotation therewith and a cog belt arranged to pass about said cog wheels for transmission of power therebetween, and in which said resilient means comprises a coil spring interposed between said cam and one of said cog wheels mounted on said cam shaft and yieldingly interconnecting while urging same in the opposite directions, and an abutment mounted on said cam shaft for holding said cam axially in place on said cam shaft under the bias of said spring.

6. A variable valve timing mechanism as set forth in claim 1, further comprising guiding means for guidingly connecting said rocker arm at a point intermediate between the ends thereof with said lever, and spring means interposed between said rocker arm and said lever for urging said other end of said lever against said cam.

7. A variable valve timing mechanism as set forth in claim 6, in which said guide means comprises a shaft secured to said rocker arm at a location intermediate between the ends thereof in a manner to project out from either side of the rocker arm, a pair of guide forks provided to either side of said lever and respectively formed with guide slots and a pair of rectangular slides respectively formed with round guide holes and mounted in said guide slots for movement along same but against rotation about the axes of said round guide holes, said shaft being rotatably received at its opposite end portions in said guide slots.

8. A variable valve timing mechanism as set forth in claim 1, in which said cam is formed with at least one nearly flat cam surface portion.

9. A variable valve timing mechanism as set forth in claim 8, in which said cam is formed with said nearly flat cam surface portion at a location where it is brought into contact with said lever under high engine speed conditions.

10. A variable valve timing mechanism as set forth in claim 1, in which said cam has an annular stepped configuration and includes a larger-circumference central portion and a pair of smaller-circumference journal portions which are axially aligned with each other and protrude from said central portion in opposite directions, said cam being formed with a cam surface at said central portion and rotatably mounted at said journal portions on said engine.

11. A variable valve timing mechanism as set forth in claim 10, in which said resilient means comprises a pair of coil springs positioned around said cam shaft and yieldingly interconnecting said journal portions and said cam shaft.

12. A variable valve timing mechanism as set forth in claim 11, in which said cam shaft is directly connected to said output shaft of said driving means.

13. A variable valve timing mechanism as set forth in claim 1, in which said resilient means comprises a spring positioned around said cam shaft and yieldingly interconnecting said cam and said cam shaft.

14. A variable valve timing mechanism as set forth in claim 13, in which said spring is a coil spring.

15. A variable valve timing mechanism as set forth in claim 13, in which said spring is a spiral spring.

16. A variable valve timing mechanism as set forth in claim 13, in which said resilient means further comprises a groove formed in said cam at an end opposite to the end connected to said spring and a pin secured to said cam shaft and movable in said groove, said groove having a predetermined angular extension and said pin being engageable with the ends of said groove to limit a rotatable extent of said cam relative to said cam shaft.

17. A variable valve timing mechanism as set forth in claim 1, in which said driving means further comprises a first gear rotatably mounted on said cam shaft, a second gear meshed with said first gear and a drive shaft drivingly connected to said output shaft and mounting thereon said second gear to rotate therewith, and in which said resilient means comprises a coil spring interposed between said cam and said first gear and yieldingly interconnecting while urging same in opposite directions, and a pair of abutments mounted on said cam shaft for holding said cam and said first gear axially in place on said cam shaft under the bias of said coil spring.

18. A variable valve timing mechanism as set forth in claim 17, in which the number of teeth of said first gear is larger than that of said second gear.

19. A variable valve timing mechanism as set forth in claim 17, in which said abutments comprise a pair of snap rings.

20. A variable valve timing mechanism as set forth in claim 17, in which said cam shaft is stationarily mounted on said engine.

21. A variable valve timing mechanism as set forth in claim 20, in which said cam has a plurality of nearly flat cam surface portions for inducing a stepwise variation of the timing of said valve, said cam also having a waved signal end opposite to the end facing said first gear, and in which said resilient means further comprises a collar secured to said cam shaft and having a waved end, said waved ends of said cam and said collar being so formed that they snugly fit in each other only when some of said cam surface portions is correctly in contact with said lever.

22. A variable valve timing mechanism as set forth in claim 1, in which said driving means further comprises a drive shaft drivingly connected to said output shaft, a main pulley mounted on said drive shaft for rotation therewith, a follower pulley mounted on said cam shaft for rotation therewith and a belt arranged to pass about said pulleys for transmission of power therebetween, and in which said resilient means comprises a coil spring interposed between said cam and said follower pulley and yieldingly interconnecting while urging same in the opposite directions, and an abutment mounted on said cam shaft for holding said cam axially in place on said cam shaft under the bias of said spring.

23. A variable valve timing mechanism as set forth in claim 22, in which said main pulley is smaller in diameter than said follower pulley.

24. A variable valve timing mechanism as set forth in claim 23, in which said belt is of a round section.

25. A variable valve timing mechanism as set forth in claim 23, in which said belt is a flat belt.

* * * * *